US007174662B1

(12) United States Patent
Brown

(10) Patent No.: US 7,174,662 B1
(45) Date of Patent: Feb. 13, 2007

(54) APPARATUS FOR PRE-STARCHED IRONING PADS

(76) Inventor: Tracy Brown, 7600 Myron Ave., Cleveland, OH (US) 44103

( * ) Notice: Subject to any disclaimer, the term of this patent is extended or adjusted under 35 U.S.C. 154(b) by 140 days.

(21) Appl. No.: 11/196,205

(22) Filed: Aug. 4, 2005

(51) Int. Cl.
*D06F 83/00* (2006.01)

(52) U.S. Cl. ..... 38/140

(58) Field of Classification Search ..... 38/12, 38/14, 66, 137, 140; D32/66; 428/101, 428/102, 441.1
See application file for complete search history.

(56) References Cited

U.S. PATENT DOCUMENTS 3,007,267 A * 11/1961 Goldsmith ..... 38/140
3,049,826 A 8/1962 Goldsmith
3,568,970 A 3/1971 Mallett
3,911,603 A 10/1975 Lehrman
4,484,400 A 11/1984 Lehrman
4,647,487 A * 3/1987 O'Neill ..... 428/81
4,920,669 A 5/1990 Mattesky
5,231,777 A 8/1993 Mattesky et al.
5,335,431 A * 8/1994 Ohnishi ..... 38/1 B
5,359,792 A * 11/1994 Hanada et al. ..... 38/72
D360,508 S 7/1995 Hoover
5,452,530 A * 9/1995 Cartabbia ..... 38/12
5,909,964 A * 6/1999 Johns ..... 38/1 B
2003/0136035 A1 7/2003 Lehrman

* cited by examiner

*Primary Examiner*—Ismael Izaguirre

(57) ABSTRACT

The invention pertains to an ironing board pad with a top and bottom layer of cloth, which attaches to any standard size ironing board. There are elastic straps at the wide end of the pad, and a sleeve-like nose for attachment at the narrow end of the ironing board. Each of the two layers of the pad is inundated with a combination of corn starch, borax, processing aids, preservatives, ironing aid and perfume. Thus, a person is able to simply place the article of clothing between these layers and use a steam producing iron to get clothing carefully starched, without the use of an awkward spray starch can.

1 Claim, 3 Drawing Sheets

APPARATUS FOR PRE-STARCHED IRONING PADS

BACKGROUND

1. Field

The present disclosure pertains to a dual-layer ironing board pad, with the bottom layer containing starch, borax, processors, preservatives and perfumes, all of which are activated by steam from the iron, thus freeing the user from having to use an aerosol starch can.

2. Description of Related Art

The need for ironing board covers is well known in the art.

For example, the following patents 3,911,603, 3,049,826, 2003/0136035, Des. 360,508, and 4,484,400 all describe devices that provide ironing board covers.

However, these other devices are different from the present apparatus in a variety of ways. The prior art either consist of metallic covers, have only a bottom layer, or only emit fragrance.

BRIEF DESCRIPTION OF THE FIGURES

The present invention is illustrated by way of example and not limitation in the Figures of the accompanying drawings.

DETAILED DESCRIPTION

The following description provides an ironing board pad apparatus that allows ironing without the use of spray starch. In the following description, numerous specific details are set forth in order to provide a more thorough understanding of the present invention. It will be appreciated, however, by one skilled in the art that the invention may be practiced without such specific details. Those of ordinary skill in the art, with the included descriptions, will be able to implement the starch-filled ironing board pad.

As previously described, various problems exist for prior ironing board pads. For example, they only consist of a foam-padded cover, with either a metallic or cloth surface. If they contain any additives, it is either only fragrance, or if there is starch, it is located only in the bottom layer of the pad. In contrast, in one aspect, the claimed subject matter depicts an apparatus that consists of a dual-layered cloth ironing pad with a space for clothing to fit between the layers, elastic straps for secure attachment at each corner, and a mixture of corn starch, borax, processing aids, preservatives, ironing aid and perfume in each layer of the pad, all of which emit into the chosen article of clothing via steam from an iron.

Figure 1:
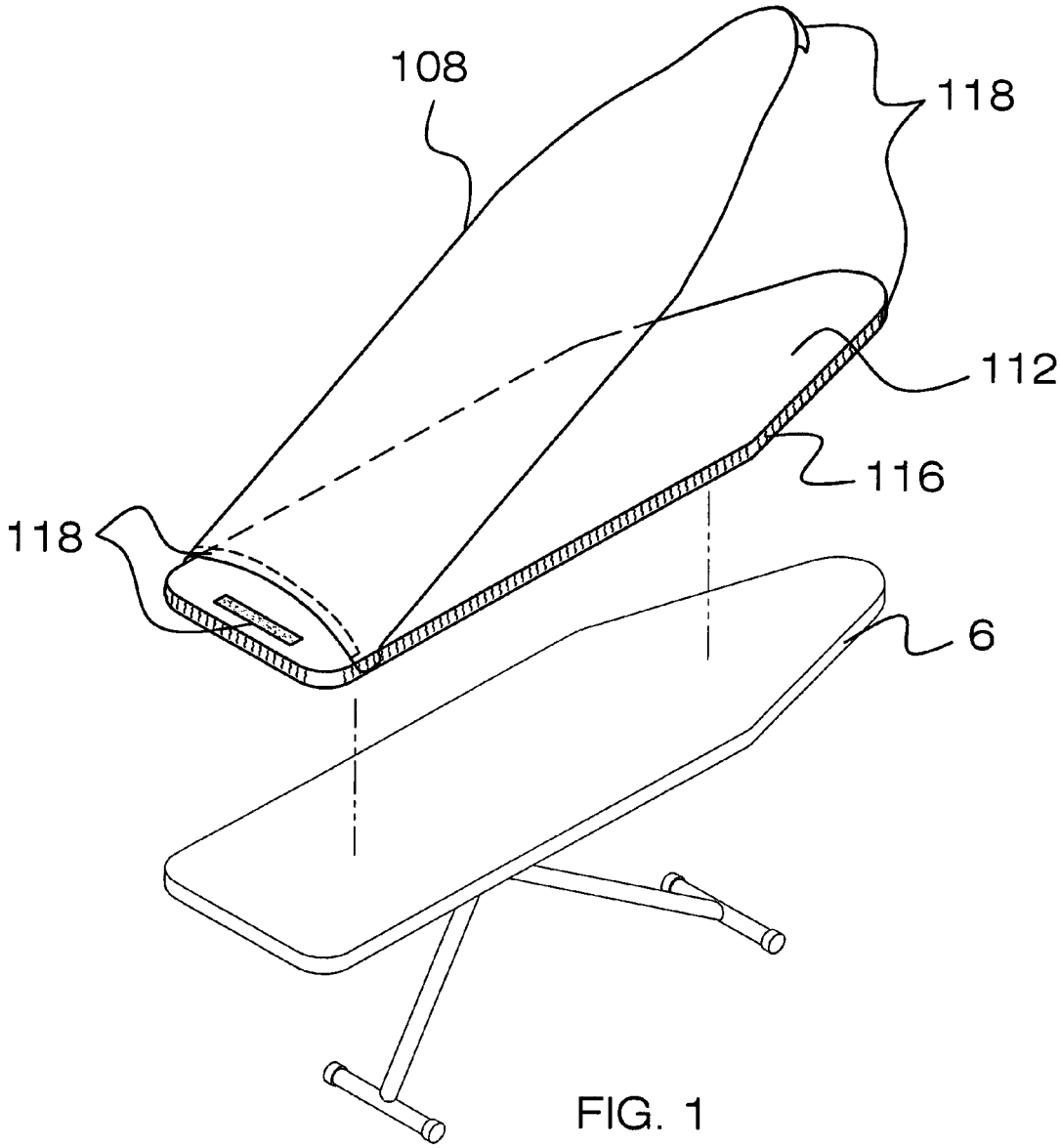
FIG. 1 illustrates a side view of the starch pad above a standard ironing board.

FIG. 1 illustrates a side view of an apparatus featuring, in one embodiment, a cloth-covered foam ironing pad with a top pad 108 and a bottom pad 112 that fits on a standard ironing board 6, and the top pad to be secured to the bottom pad with a first and a second velcro strip at a nose portion of both pads and the iron pad to be secured to the ironing board via an elastic strip surrounding the edge of the bottom bad.

Figure 2:
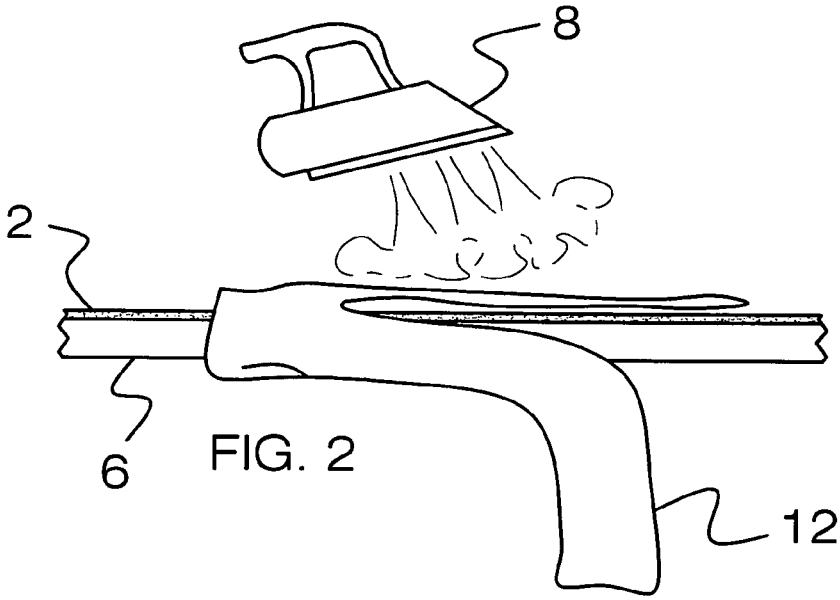
FIG. 2 illustrates a cross-sectional side view of the apparatus on an ironing board, depicting how the hot steam emitted from an iron releases starch in the pad.

FIG. 2 illustrates a cross-sectional side view of a portion of the starch pad 2 attached to an ironing board 6. An iron 8 is depicting emitting steam which heats and releases the starch 10 and other ingredients located in the starch pad 2. Laying upon the starch pad 2 is an item of clothing 12 in the process of being ironed. This Figure depicts the overall beneficial addition of the starch pad 2 during the ironing process.

Figure 3:
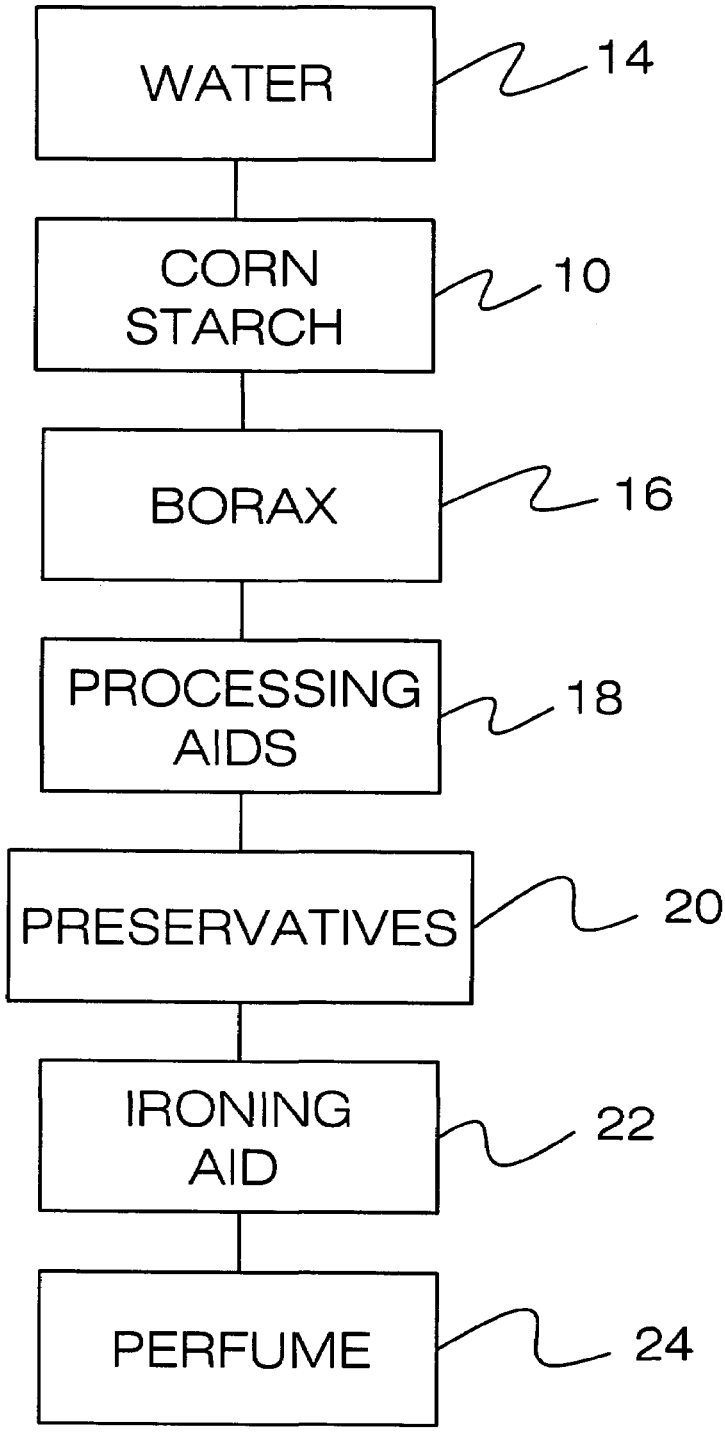
FIG. 3 illustrates the combination of additives in the ironing pad.

FIG. 3 illustrates the combination of ingredients in the starch pad 2. The starch pad 2 is activated with hot water in the form of steam from an iron 8. Included in the pad are: corn starch 10, borax 16, processing aids 18, preservatives 20, ironing aid 22, and perfume 24. Overall, these components allow a user to iron without an awkward spray starch can, while they scent the ironed article.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art upon studying this disclosure.

What is claimed is:

1. An apparatus for an ironing board pad, comprising:

a cloth pad with an upper and a lower layer, the cloth pad to be secured via a strap to an ironing board, with a space for the ironed article of clothing between said upper and lower layers;

the layers containing a mixture of corn starch, borax, processing aids, preservatives, ironing aid, and perfume that are activated into the clothing by steam from an iron;

A pair of elastic straps at a nose shaped end of the pad for attachment to a a nose shaped end of a standard ironing board, and a slot at a second end of the pad allowing attachment at the other end of the ironing board.

* * * * *